United States Patent [19]

Mozeliak

[11] Patent Number: 4,967,476

[45] Date of Patent: Nov. 6, 1990

[54] TRIM CUTTING TOOL

[76] Inventor: Daniel J. Mozeliak, P.O. Box 70, Stevens, Pa. 17578

[21] Appl. No.: 486,301

[22] Filed: Feb. 28, 1990

[51] Int. Cl.[5] ..... B26B 3/00; B26B 1/00; B25F 3/00; B26D 3/00

[52] U.S. Cl. ..... 30/312; 30/129; 30/164.5; 83/51

[58] Field of Search ..... 30/125, 143, 151, 162, 30/163, 329, 332, 333, 334, 335, 337, 164, 355, 368; 83/51, 54, 191

[56] References Cited

U.S. PATENT DOCUMENTS

| | | | |
|---|---|---|---|
| 1,589,156 | 6/1926 | Hartman | 30/312 |
| 2,211,577 | 8/1940 | Muserlian | 30/163 |
| 4,068,375 | 1/1978 | Rathburn et al. | 30/164 |
| 4,571,828 | 2/1986 | Miffitt | 30/164.95 |
| 4,641,438 | 9/1987 | Insolio | 30/164.5 |
| 4,781,089 | 11/1988 | Gerber et al. | 83/51 |

*Primary Examiner*—Douglas D. Watts
*Assistant Examiner*—Paul M. Heyrana, Sr.
*Attorney, Agent, or Firm*—Leon Gilden

[57] ABSTRACT

A tool structure including an elongate, generally "V" shaped body defining an acute angle between the body portions, wherein a generally reversible trapezoidal blade is mounted within the body to project exteriorly thereof. A flexible cable is mounted and extends from a side surface of the body, with a handle orthogonally mounted medially of its length to the cable to provide a flexible manipulatable pulling handle in association with the blade structure. A removable cover is optionally mounted overlying a forward portion of the handle encompassing the blade, wherein the cover is deflectable to avoid destruction of the blade in its association with the work piece.

4 Claims, 4 Drawing Sheets

Fig 1
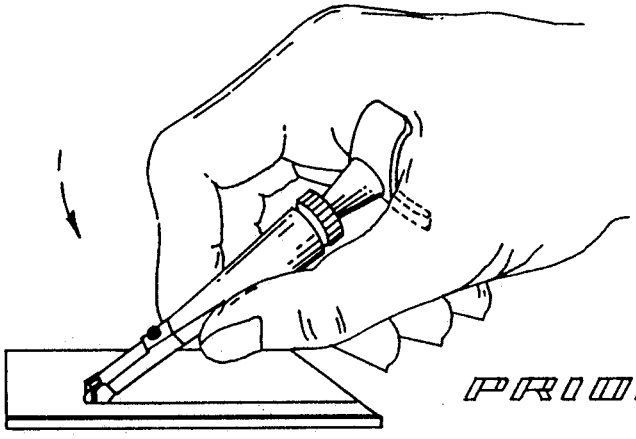
PRIOR ART
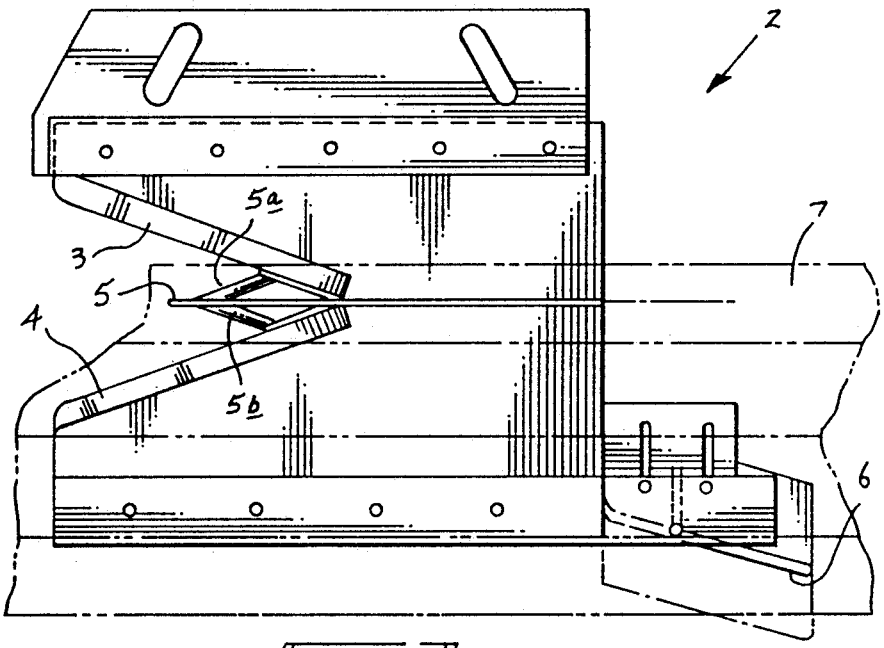
Fig 2
PRIOR ART

TRIM CUTTING TOOL

BACKGROUND OF THE INVENTION

1. Field of the Invention

The field of invention relates to cutting tools, and more particularly pertains to a new and improved trim cutting tool wherein the same is positionable adjacent a sheet of glass to trim associated insulative caulking material and adhesives relative to the glass surface.

2. Description of the Prior Art

Cutting tools of various types have been utilized throughout the prior art. In the installation of glass and the like, various sealinG and gasket type materials are utilized. Subsequently these materials are removed to provide a relatively neat and attractive finished installation of the glass. Cutting tools of the prior art have heretofore failed to provide a cutting tool organization particularly directed to this trimming operation, wherein extended effort is required to direct an associated cutting tip through various insulative bodies. Examples of the prior art include U.S. Pat. No. 4,816,536 to Thomas wherein an elongate handle is arranged for being pushed along a glass surface to cut the glass and minimize stress on a wrist and hand portion of an individual's body in performing the cutting procedure.

U.S. Pat. No. 4,781,089 to Gerber, et al., provides a means of longitudinally cutting a fibrous tubular product in a step-shaped profile utilizing variously angulated blades positioned relative to one another to effect this cutting procedure.

U.S. Pat. No. 4,327,488 to Connolly is illustrative of a hand tool utilizing a handle of a generally compound curved structure to secure a glass cutting blade at a forward end thereof.

U.S. Pat. No. 4,691,438 to Insolio provides a glass cutting blade structure wherein a preselected pressure on the cutting blade is limited regardless of pressure applied to the associated handle of the blade structure.

U.S. Pat. No. 4,571,828 provides a glass cutting tool formed with an elongate body whereupon force upon the cutting head will displace it rearwardly into the handle to direct lubricant to the associated cutting blade.

As such, it may be appreciated that there continues to be a need for a new and improved trim cutting tool as set forth by the instant invention which addresses both the problems of ease of use, as well as effectiveness in construction to effectively cut and trim insulative products adjacent and contiguously mounted to a glass surface and in this respect, the present Invention substantially fulfills this need.

SUMMARY OF THE INVENTION

In view of the foregoing disadvantages inherent in the known types of cutting tools now present in the prior art, the present invention provides a trim cutting tool wherein the same provides an angulated handle to appropriately orient a cutting blade relative to a glass cutting surface and afford a greater degree of control of the cutting blade in the cutting procedure, as well as utilizing a cable assist handle to enhance pressure applied to the cutting blade in use. As such, the general purpose of the present invention, which will be described subsequently in greater detail, is to provide a new and improved trim cutting tool which has all the advantages of the prior art cutting tools and none of the disadvantages.

To attain this, the present invention provides a tool structure including an elongate, generally "V" shaped body defining an acute angle between the body portions, wherein a generally reversible trapezoidal blade is mounted within the body to project exteriorly thereof. A flexible cable is mounted and extends from a side surface of the body, with a handle orthogonally mounted medially of its length to the cable to provide a flexible manipulatable pulling handle in association with the blade structure. A removable cover is optionally mounted overlying a forward portion of the handle encompassing the blade, wherein the cover is deflectable to avoid destruction of the blade in its association with the work piece.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trim cutting tool which has all the advantages of the prior art cutting tools and none of the disadvantages.

It is another object of the present invention to provide a new and improved trim cutting tool which may be easily and efficiently manufactured and marketed.

It is a further object of the present invention to provide a new and improved trim cutting tool which is of a durable and reliable construction.

An even further object of the present invention is to provide a new and improved trim cutting tool which is susceptible of a low cost of manufacture with regard to both materials and labor, and which accordingly is then susceptible of low prices of sale to the consuming public, thereby making such trim cutting tools economically available to the buying public.

Still yet another object of the present invention is to provide a new and improved trim cutting tool which provides in the apparatuses and methods of the prior art some of the advantages thereof, while simultaneously overcoming some of the disadvantages normally associated therewith.

Still another object of the present invention is to provide a new and improved trim cutting tool wherein the same affords a greater degree of accuracy and enables application of greater levels of pressure to a cutting blade in removing and severing insulative trim from a glass surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art cutting tool.

FIG. 2 is an orthographic view of a further prior art cutting tool arrangement.

DESCRIPTION OF THE PREFERRED EMBODIMENT

Figure 3:
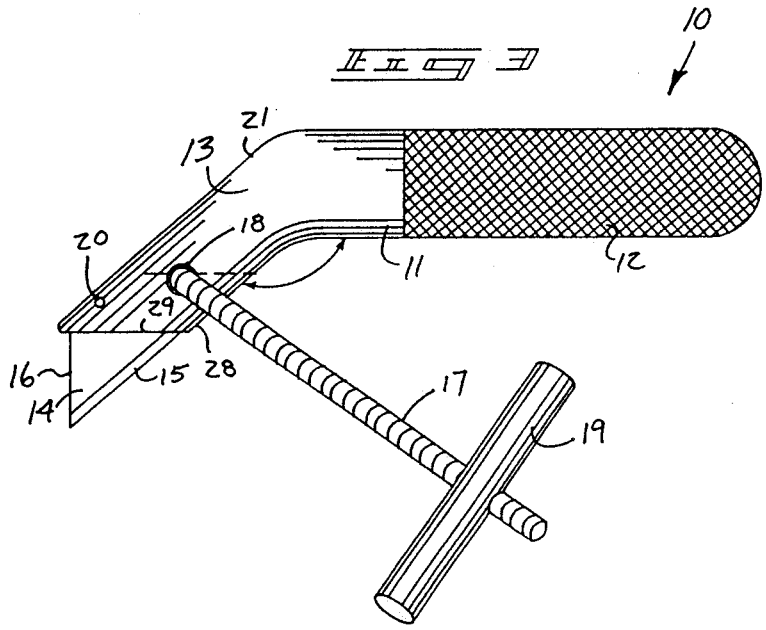
FIG. 3 is an isometric illustration of the instant invention.

With reference now to the drawings, and in particular to FIGS. 1 to 8 thereof, a new and improved trim cutting tool embodying the principles and concepts of the present invention and generally designated by the reference numeral 10 will be described.

FIG. 1 illustrates a prior art cutting tool 1 defined by an elongate handle body and a rearwardly directed arcuate surface to direct pressure to the scoring tool at the forward tip of the elongate body. FIG. 2 illustrates a cutting tool to provide a stepped cutting operation onto a fibrous wall 7, wherein a series of blades 3, 4, and 5 each utilize various cutting edges, such as edges 5*a* and 5*b*, as well as a rearwardly directed blade 6 to effect a multiple cutting operation upon the work piece.

Figure 4:
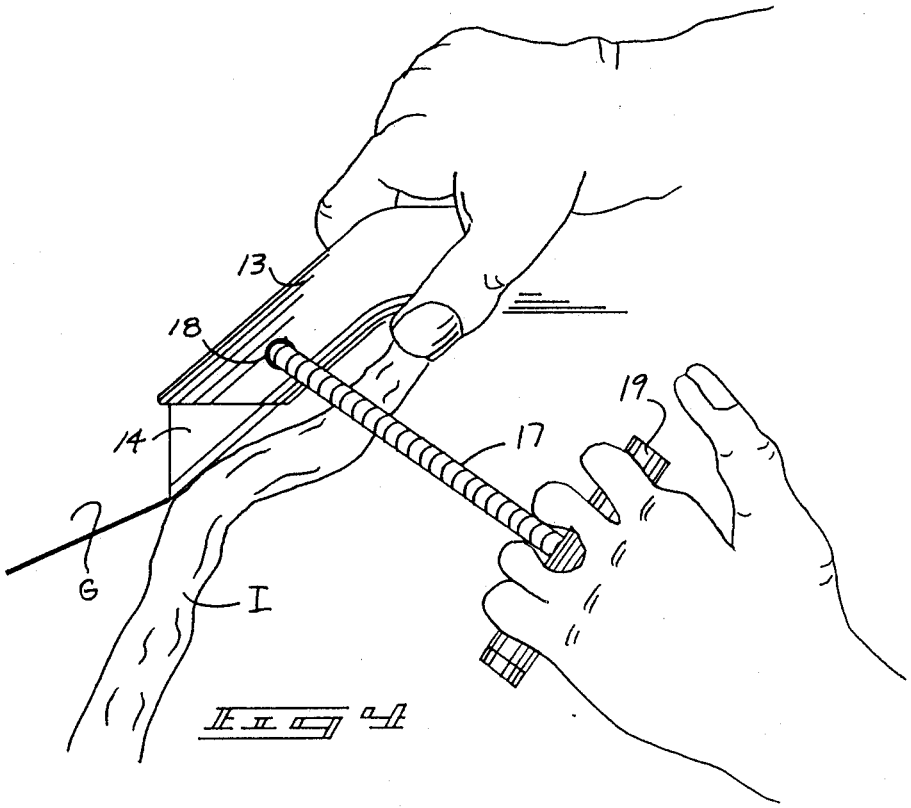
FIG. 4 is an isometric illustration of the instant invention in use.

More specifically, the trim cutting tool 10 of the instant invention essentially comprises a generally "V" shaped handle defined by a longitudinally aligned top handle body 11 formed with a frictional securement surface 12 coextensively mounted about a majority of the top handle body, with a blade support body 18 directed downwardly from the top handle body arranged at generally a forty-five degree included angle therebetween to provide for manual securement of the top handle body and its repositioning out of a line of sight or vision of the blade associated with the organization to afford greater maneuverability, as well as enhanced visibility in use of the tool. The blade support body 13 includes a generally trapezoidal cutting blade 14 mounted therewithin formed with a cutting edge 15 aligned with a bottom edge 28 of the blade support body projecting exteriorly thereof, wherein the blade support body includes a forward edge 29 arranged at a generally acute or forty-five degree angle relative to the bottom edge 28 or an associated upper edge 21 defining the upper edge of the blade support body. The cutting blade 14 includes a rearwardly directed forward edge 16 defining an acute included angle between the cutting edge 15 and the forward edge 16 of the blade 14. A flexible cable 17 is mounted to a cable mount 18 directed orthogonally through the blade support body 13, wherein the flexible cable 17 extends laterally of the blade support body, with a cable handle 19 mounted adjacent a remote terminal end of the flexible cable 17, with the cable 17 directed medially through the cable handle 19 to permit enhanced grasping and manipulation of the tool in use, as illustrated in FIG. 4, to separate a segment of insulative trim "I" from an associated glass surface "G".

Figure 5:
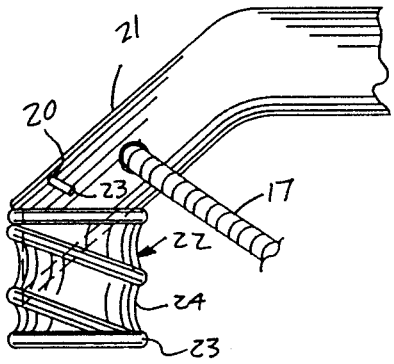
FIG. 5 is a fragmented orthographic side view of the forward handle portion of the instant invention.
Figure 6:
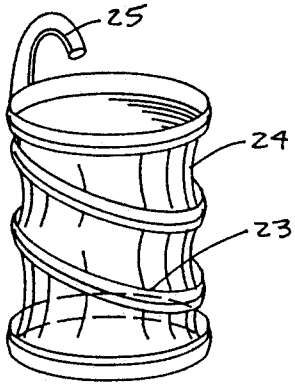
FIG. 6 is an isometric illustration of the shield utilized by the instant invention.

FIG. 5 illustrates the use of a cylindrical cutting shield 22 formed with a metallic coil spring frame work 23 defined by cylindrical upper and lower ends coaxially aligned relative to one another, with a spiral central spring portion formed between the upper and lower ends, with a flexible sheath 24 mounted in surrounding relationship interiorly of the spring framework 23. In this manner, the sheath 24 prevents inadvertent introduction of an individual's finger and the like in association with the blade edge 15, and whereupon the spring-like framework 28 permits collapsing and extension of the sheath to ensure surrounding of the cutting blade while permitting the sheath to be retracted relative to some insulative trim "I" during use. The spring framework 23 includes an arcuate upper free end 25 of a generally "J" shaped configuration and extends above the sheath 24, and is received within a through-extending aperture 20 formed through the blade support body 18 adjacent the forward edge 29 and the upper edge 21.

Figure 7:
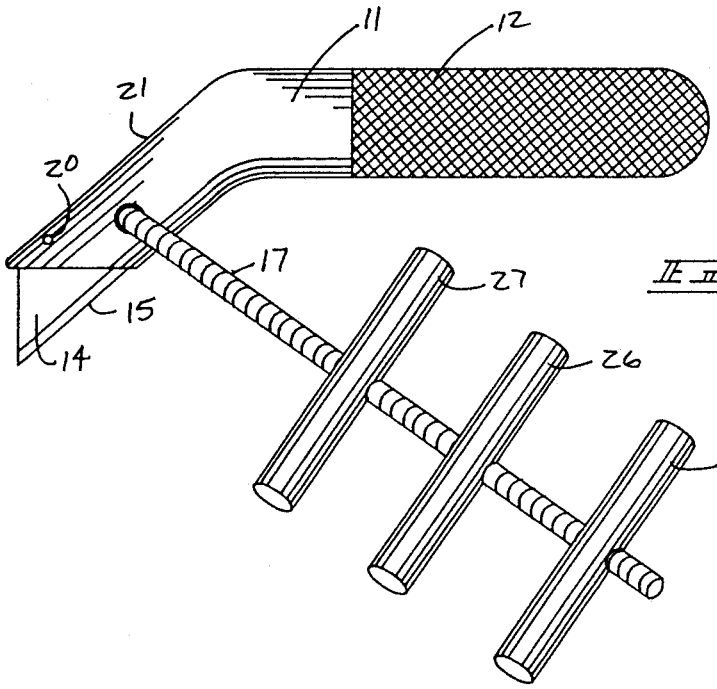
FIG. 7 is orthographic side view of the cutting tool utilizing an handle structure.
Figure 8:
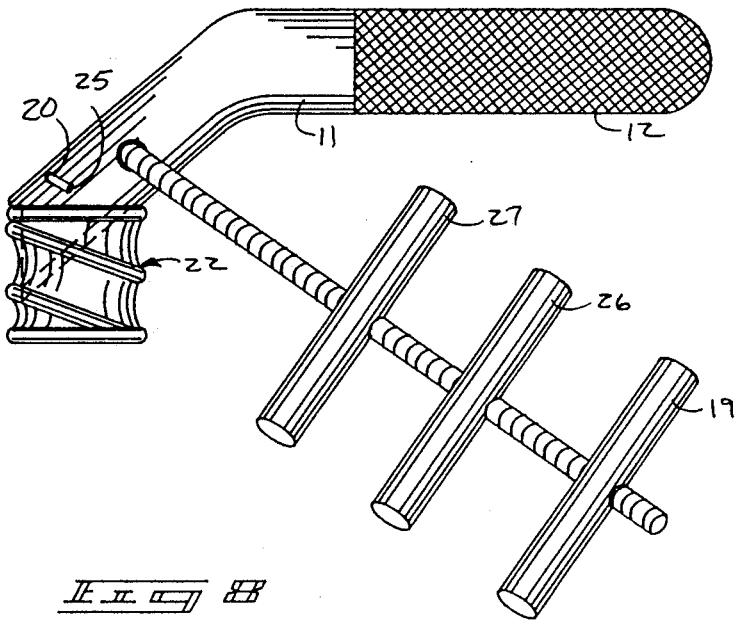
FIG. 8 an orthographic side view taken in elevation of the invention utilizing the shield and improved handle structure.

FIGS. 7 and 8 illustrate the invention utilizing a second and third cable handle 26 and 27 respectively mounted at equally spaced intervals relative to one another and the first cable handle 19 to permit selective grasping of one of the cable handles to thereby permit selective orientation and grip of the cable during use, dependent upon the available space surrounding a sheet of glass "G" in a trim cutting procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A trim cutting tool comprising, a longitudinally aligned top handle, the top handle including a frictional surface formed about a major surface of the top handle, and a blade support body integrally formed to and arranged downwardly, relative to the top handle defining an included angle therebetween, and the blade support body mounting a cutting blade therewithin, the cutting blade extending exteriorly of the blade support body, and the blade support body including a bottom edge and a top edge spaced relative to one another, with the cutting blade including a cutting edge substantially aligned with the bottom edge of the blade support body, and the blade support body including a forward edge arranged at a generally further acute included angle between the cutting edge and the forward edge, and a flexible cable mounted to a side surface of the blade support body and extending laterally thereof, and the flexible cable including an elongated handle mounted adjacent a remote terminal end of the flexible cable spaced from the blade support body, and the flexible cable directed medially through the handle.

2. A trim cutting tool as set forth in claim 1 wherein the blade support body further includes a through-extending aperture directed therethrough adjacent a top edge of the blade support body and the forward edge, and a shield mounted in a surrounding relationship relative to the cutting blade and secured to the blade support body through the through-extending apertures.

3. A trim cutting tool as set forth in claim 2 wherein the shield comprises a generally cylindrical shield including an upper and lower cylindrical end coaxially aligned relative to one another, with a spiral spring-like skeleton member mounted between the upper and lower ends, and a flexible sheath mounted coextensively and interiorly of the upper and lower ends and the spiral member, and the upper end including a generally "J" shaped projection directed upwardly of the upper end, with the "J" shaped projection receivable through the through-extending aperture to secure the sheath in a surrounding relationship relative to the cutting blade.

4. A trim cutting tool as set forth in claim 3 wherein the flexible sheath includes a second and third handle member fixedly mounted to the flexible cable, wherein the second and third handle members are arranged at equally spaced intervals relative to one another to afford an individual a variety of grasping positions of the flexible cable relative to the blade support body.

* * * * *